US005429515A

United States Patent [19]

Greenwood

[11] Patent Number: 5,429,515

[45] Date of Patent: Jul. 4, 1995

[54] HORSE RIDING TRAINING APPARATUS

[76] Inventor: William R. Greenwood, The Mount, Park Road, Tarporley, CW6 0AN., England

[21] Appl. No.: 100,765

[22] Filed: Aug. 2, 1993

[51] Int. Cl.[6] ..... A63B 69/04

[52] U.S. Cl. ..... 434/247; 446/29

[58] Field of Search ..... 434/219, 247, 225; 446/29

[56] References Cited

U.S. PATENT DOCUMENTS

| | | | |
|---|---|---|---|
| 3,672,075 | 6/1972 | Eikelenboom | 434/247 |
| 4,190,968 | 3/1980 | Clapp et al. | 434/247 |
| 4,957,444 | 9/1990 | Armen | 434/247 |
| 4,988,300 | 1/1991 | Yamaguchi et al. | 434/247 |

FOREIGN PATENT DOCUMENTS

| | | | |
|---|---|---|---|
| 0407158 | 1/1991 | European Pat. Off. . | |
| 2595956 | 9/1987 | France | 472/99 |
| 5076658 | 3/1993 | Japan | 472/95 |
| 1301773 | 1/1973 | United Kingdom . | |
| 2233913 | 1/1991 | United Kingdom . | |
| 2256597 | 12/1992 | United Kingdom | 472/97 |

*Primary Examiner*—Gene Mancene
*Assistant Examiner*—Jeffrey A. Smith
*Attorney, Agent, or Firm*—Bernard L. Kleinke; Richard D. Clark

[57] ABSTRACT

The apparatus helps riders to train for horse riding and comprises a body portion and a neck portion. The neck portion is pivotally mounted to the body portion. The apparatus gives accurate simulation of the movements of a horse. It may have powered means for moving the body portion with respect to the base and the neck portions may be pivotally mounted about two curved pivotal axes. A head may be pivotally mounted to the neck about a horizontal axis and link mans may extend between the head and body to cause the head to pivot in the opposite direction to the body.

8 Claims, 5 Drawing Sheets

HORSE RIDING TRAINING APPARATUS

The present invention relates to horse riding training apparatus, and in particular, but not exclusively, to jockey training apparatus.

It is necessary for jockeys to ride several times a day in order to maintain their fitness and to practice and improve riding technique. This is normally achieved by riding in several races on the same day, or during the training programme for horses in which the horses are ridden every day.

However, it is not always possible for a jockey to have sufficient rides to maintain his fitness and to practise his technique, and indeed in adverse weather conditions it may not be possible to ride at all without the risk of serious injury to the horse and/or the jockey. Moreover, it may not be possible to obtain a sufficient number of rides if the jockey wishes to concentrate on a particular aspect of technique, especially since this might result in the horse receiving an unbalanced training programme.

There is also a significant problem with jockeys who are recovering from injury. Not only might it be dangerous for a recovering jockey to ride a horse when not fully fit, but it might also be necessary for a jockey to exercise the injured area more thoroughly to build up strength again. If the jockey were to ride a horse to achieve this, it is likely to be necessary to exercise on a number of horses to ensure that one particular horse is not exercised excessively simply for the benefit of the jockey.

Also, exercise by jockeys is essentially limited to daylight hours, which in the winter can significantly restrict the training which a jockey can undertake.

It is known to provide a horse riding practice device in the form of an artificial horse having a body portion approximating in shape to that of a real horse and a pivotally-mounted head which can be moved up and down to simulate a genuine riding action. Such a device goes some way to assisting a jockey in being able to overcome the aforementioned disadvantages, but the device itself has a number of drawbacks, amongst which is the fact that it does not provide a genuine horse riding action in view of the fact that the body portion upon which the rider sits is stationary, and the neck portion of the device is only capable of pivoting in a vertical plane.

It is an object of the present invention to provide a horse riding training apparatus which overcomes or alleviates the problems associated with the prior art device.

In accordance with a first aspect of the present invention, a horse riding training aid comprises a base, a body portion mounted on a base, a neck portion pivotally mounted to, and extending from, the body portion, and powered means for moving the body portion with respect to the base.

In this way, it is possible to move the body portion, relative to the neck portion automatically (i.e. unaided by a jockey) and thereby simulate the movement of a horse more accurately by allowing the rear of the body portion to move upwardly as the neck portion moves upwardly and the rear to move downwardly as the neck portion moves downwardly. This rhythmic action simulates the galloping of a horse and can be coupled with pivotal movement of a head portion as will be described later with respect to a third aspect of the present invention.

In one embodiment, the powered means comprises an electric motor, which may advantageously be mounted on the base. The electric motor may be arranged to drive a crank mechanism, one end of which is pivotally connected to the body portion. Preferably, the body portion is also hingedly connected to the base. This may be achieved by hanging the body portion from one or more suspension members, e.g. connecting rods, which are pivotally mounted to the base and to the body portion.

Preferably, the crank mechanism is connected to the body portion towards the rear of the body portion, and the body portion is hingedly connected to the base further to the front of the body portion.

In accordance with a second aspect of the present invention, a horse riding training aid comprises a body portion and a neck portion extending from the body portion, the neck portion being pivotally mounted about two inclined pivotal axes.

This arrangement not only enables the neck portion to be moved up and down, but also allows the neck to drop to either side, thus encouraging a rider to correct the drop.

In one embodiment, one of the pivotal axes is generally horizontal, to enable the neck portion to be displaced generally up and down, as occurs during riding. The other axis may be inclined to the vertical and horizontal, and may be inclined upwardly towards the rear of the body portion. The training aid may comprise a pivotal member which is pivotally mounted about the inclined axis, the other pivot being located on the pivotal member.

There may be biassing means, e.g. a spring, for displacing the neck portion to either side. There may also be damping means to damp the motion induced by the biassing means. There may also be locking means, e.g. a solenoid actuated bolt, to prevent the biassing means from acting at specified times.

In accordance with a third aspect of the present invention, there is provided a horse riding training aid comprising a body portion, a neck portion pivotally mounted to, and extending from, the body portion, and a head portion pivotally mounted about a generally horizontal axis, to the distal end of the neck portion, the training aid further comprising link means extending between the head portion and the body portion which cause the head portion to pivot in the opposite direction to the neck portion.

The above arrangement ensures that as the neck is pushed downwardly, the head is tilted upwardly, thereby producing a realistic action of a horse, in which the nose leads during racing.

The link means may comprise first and second connecting rods extending between the body portion and the head portion and pivotally mounted to each about generally horizontal axes. The first and second rods may be in the form of a parallel linkage.

In accordance with a fourth aspect of the present invention, a horse riding training aid comprises a body portion, a neck portion extending from the body portion and impact-sensing means located on the body portion.

The impact sensing means are preferably located towards the end of the body portion away from the neck portion. This enables the impact-sensing means to detect whipping of the portion by a "rider" of the training aid.

Preferably, the impact-sensing means (for example, piezoelectric sensors) are adapted to produce an audible and/or visual (e.g. LED) indication when hit.

The sensing means may comprise a plurality of sensitive areas, adapted to produce different audible and/or visual indications. In this way, a rider of the training aid can practise his use of a whip on a horse.

By way of example only, a specific embodiment of the present invention will now be described, with reference to the accompanying drawings, in which.

Figure 1:
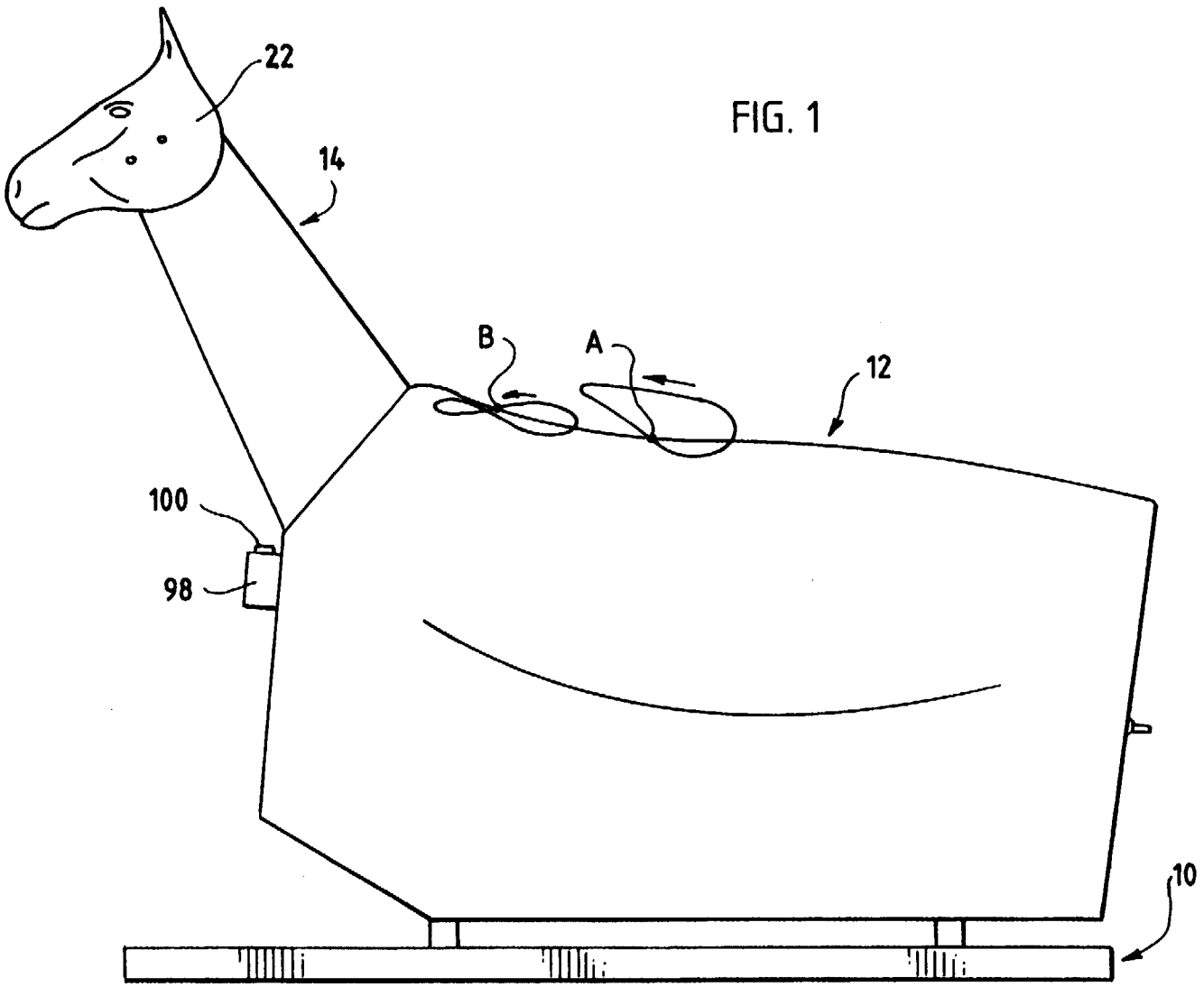
FIG. 1 is a side view of an embodiment of horse riding training apparatus in accordance with the present invention.

A horse riding training apparatus comprises a base portion 10, a body portion 12 and a neck portion 14. The base portion 10 comprises a rectangular planar base 16 which, in use, contacts the ground or other flat surface. The body portion 12 has an internal supporting frame and externally is generally in the shape of the body portion of a horse. The neck portion 14 comprises a pivotally mounted neck member 20 and a pivotally mounted head member 22 having a shape similar to the head of a horse.

Figure 2:
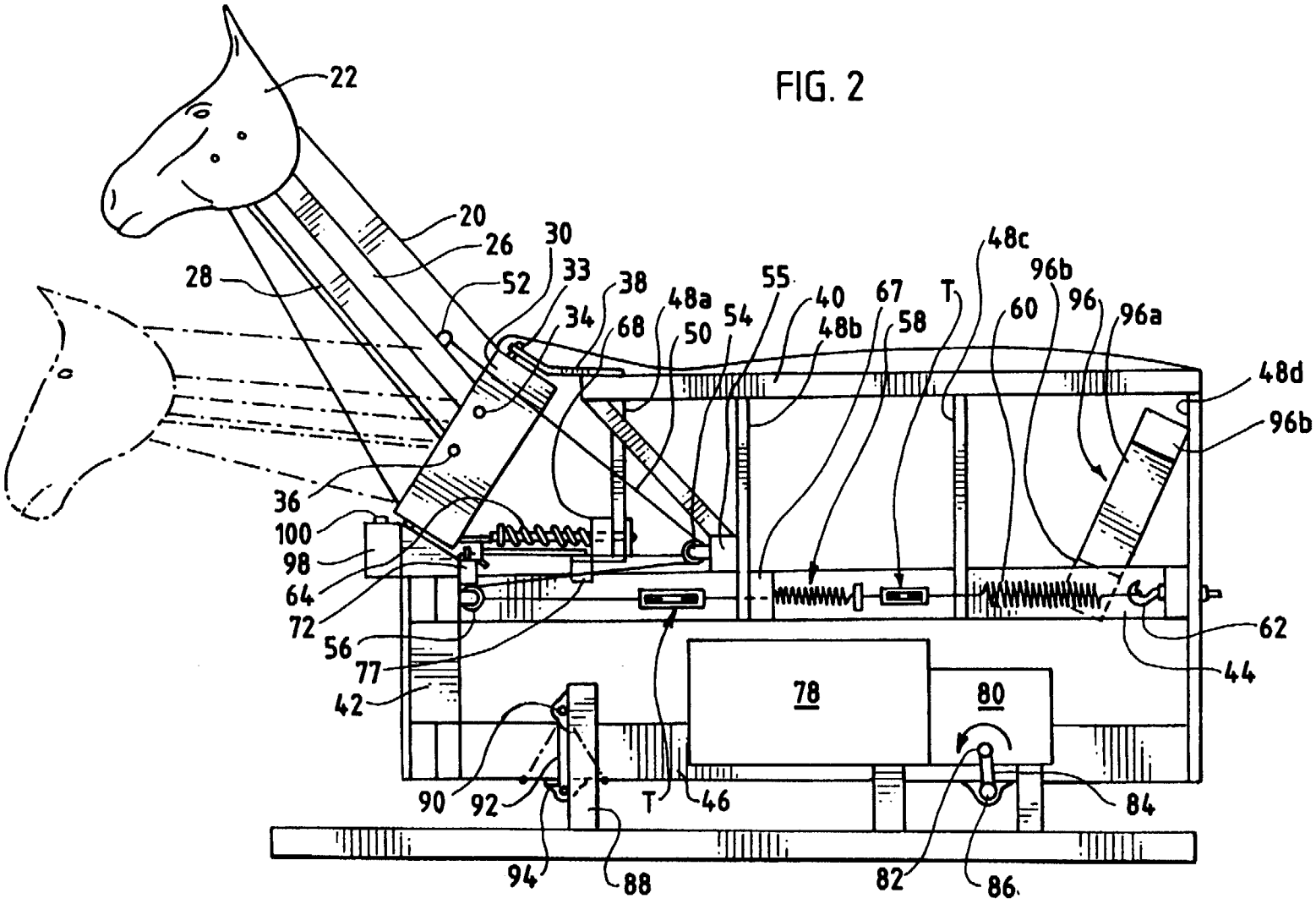
FIG. 2 is a cross-sectional view through the embodiment of FIG. 1.
Figure 3:
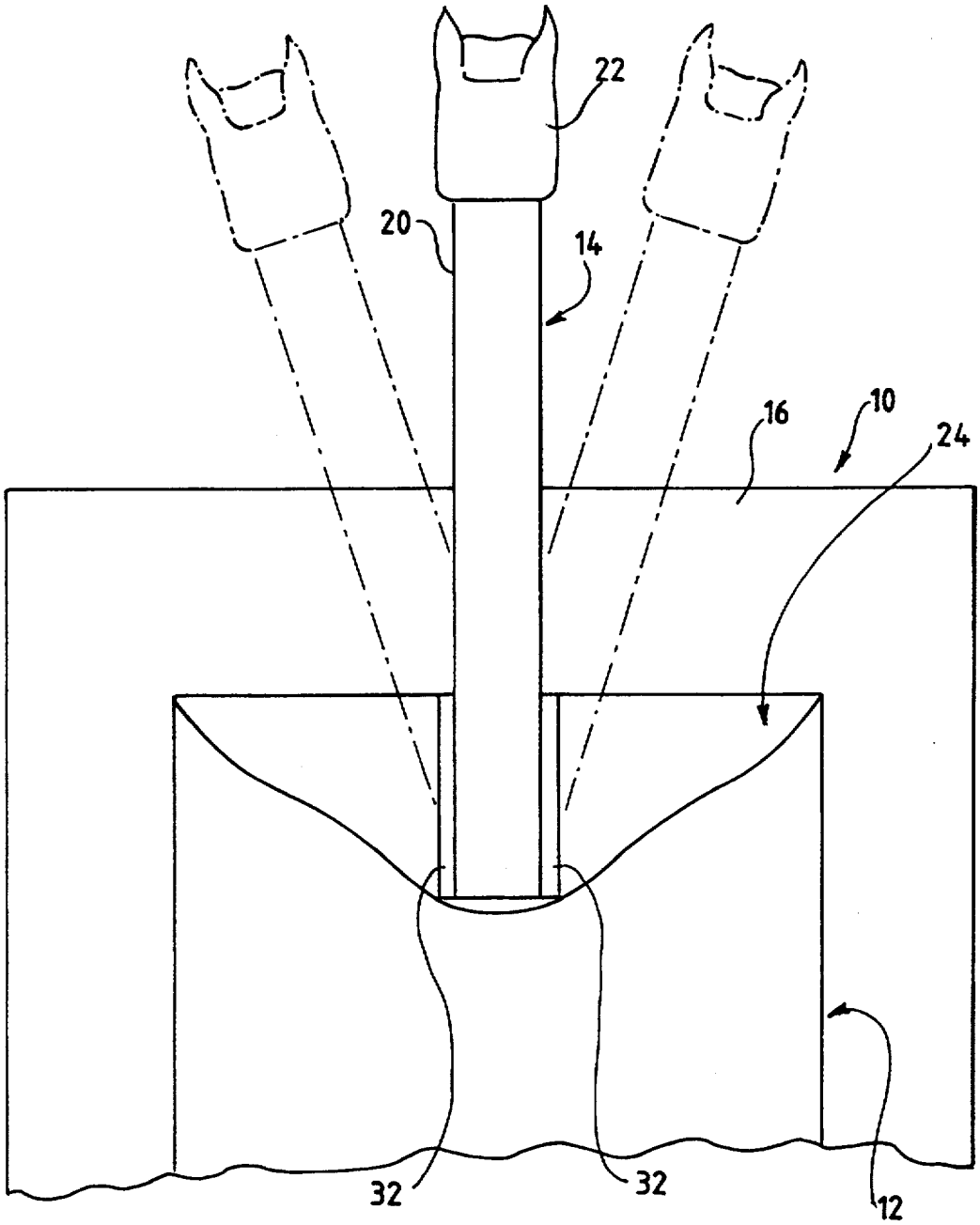
FIG. 3 is a plan view of the front portion of the embodiment of FIG. 1.

As seen in FIG. 3, the neck portion 14 of the apparatus extends from an aperture 24 in the front of the body portion. The neck member 20, as best seen in FIG. 2, is hollow and houses main and subsidiary elongate links 26, 28, each of which is pivotally attached at separate pivots to the head member 22 and to a lateral pivoting member 30. The double linkage arrangement ensures that as the neck portion 20 is pivoted downwardly, the head portion 22 is pivoted slightly upwardly about its upper pivot, which simulates more closely the movement of a horse's head. The neck member is also pivotally mounted to the same pivots as the main elongate link 26.

The lateral pivoting member 30 comprises an open rectangular structure having two upwardly and forwardly facing side walls 32 between which the lower ends of the linkages 26, 28 are pivotally mounted. The lateral pivoting member is pivoted at upper and lower pivots 34, 36. Upper side pivot 33 is mounted on an angled bracket 38 secured to an upper, longitudinally-extending frame member 40, and the lower pivot 36 is mounted on a vertical support member 42 located at the front of the body portion 12. The lateral pivotal member 30 is thus pivotally mounted about a pivotal axis which is inclined to the horizontal but which lies in a vertical plane. This enables the neck portion to be pivoted to either side of the central position, as illustrated in chaindot in FIG. 3.

Figure 4:
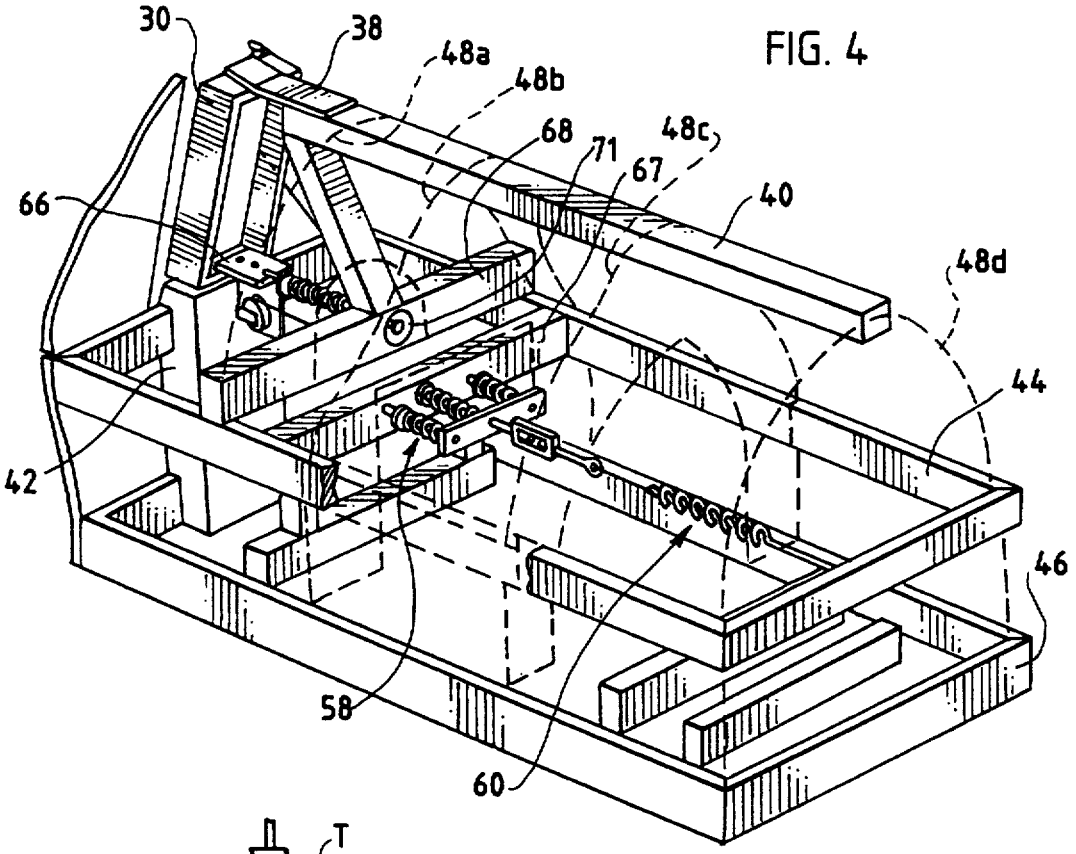
FIG. 4 is a perspective cutaway view of the base portion of the embodiment of FIG. 1 with some components omitted, for clarity.

The frame of the body portion further comprises further reinforcing members, including intermediate and lower rectangular frame portions 44, 46, and a plurality of planar, laterally extending panels **48*a* to 48*d*** in the general shape of various parts of a horse, shown in dotted outline in FIG. 4.

It will also be noted that the neck portion 20 is biassed into its uppermost position, as illustrated in full lines in FIGS. 1 and 2, by means of a spring-loaded arrangement. The arrangement comprises a metal cable 50 which extends from and is secured to a loop 52 on the main linkage member 26 of the neck. The cable 50 passes over two pulleys 54, 56 mounted within the body portion 12 on a further, lateral, reinforcing bar 55 and on the vertical member 42 respectively, such that the cable is thereby generally horizontal, and the cable is connected to first and second spring arrangements 58, 60 connected in series, one end of the spring 60 also being connected to a hook means 62 secured to the intermediate frame portion 44. The cable arrangement thus also tends to pull the neck sideways if it is slightly displaced from its central position, as the cable is attached to the neck in front of the pivotal mounting of the neck.

Figure 5:
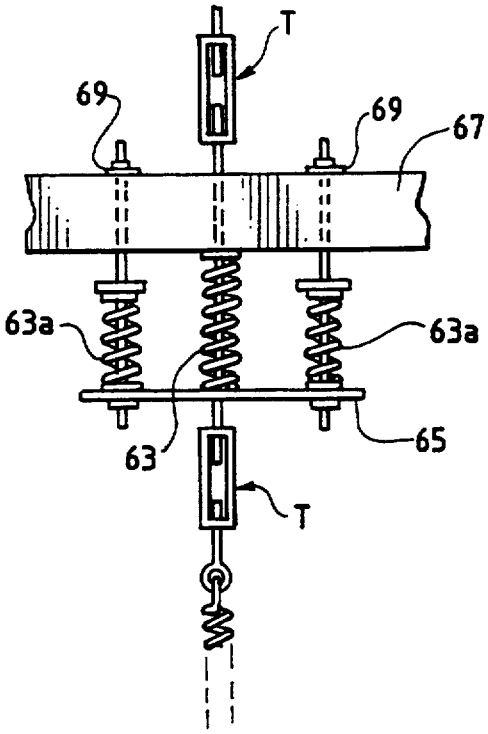
FIG. 5 is a plan view of part of the spring tensioning arrangement of the embodiment of FIG. 1.

The spring arrangement 58 is shown in more detail in FIG. 5, and comprises a central spring 63 and two auxiliary springs **63*a*. One end of each of these springs bears against a plate 65, and the central spring 63 also bears against a lateral frame member 67, thereby always being in compression. The auxiliary springs are normally uncompressed. Each spring is provided with a guide rod passing through the spring and through the frame member 67, and being bolted to the plate 65**.

As the neck portion of the arrangement is pivoted downwardly, the main spring 63 provides a resistive force. Upon further pivoting of the neck portion, the auxiliary springs **63*a* are moved into contact with the frame member 67, thereby providing a much greater resistive force, and discouraging excess pivoting of the neck portion. The upward pivoting of the neck portion is also restricted by means of washers 69 connected to the guide rods of the auxiliary springs 63*a* and which, as illustrated in FIG. 5, contact the frame member 67 to limit the rearward movement of the plate 65**.

It will also be noted that the tension of the springs may be adjusted by means of two turnbuckle arrangements T, located in front of, and behind, the spring arrangement 58.

The above arrangement allows the neck portion to be displaced downwardly against the restoring forces of the springs 60, 63 in order to simulate the movement of a horse's neck.

Figure 6:
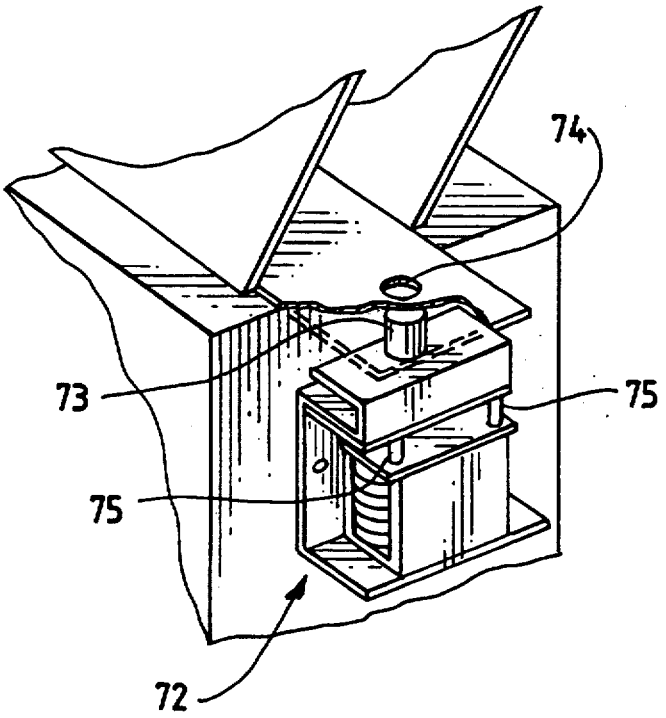
FIG. 6 is a perspective view of a lateral pivoting locking arrangement of the embodiment of FIG. 1.
Figure 7:
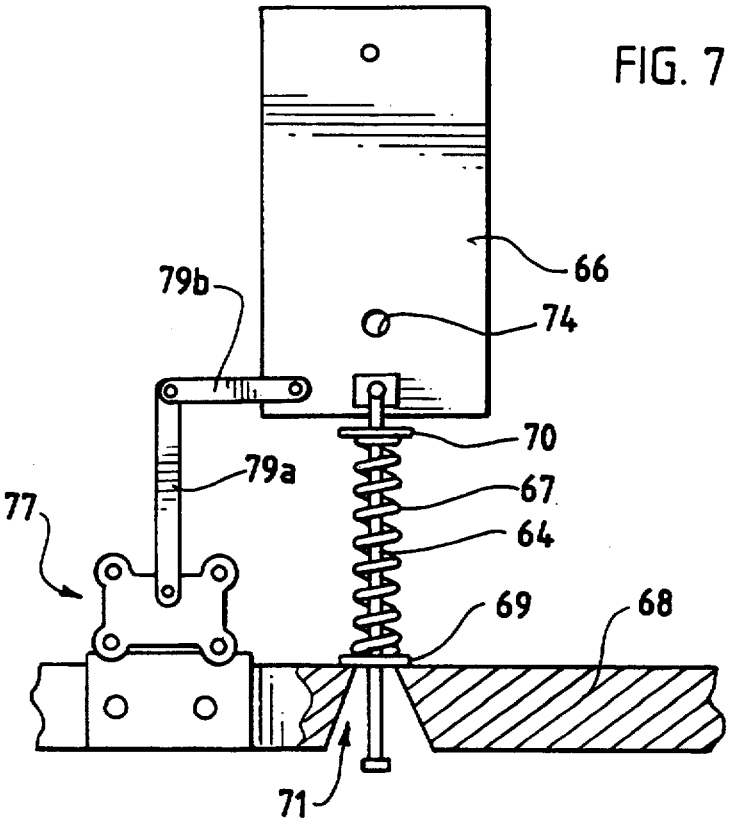
FIG. 7 is a plan view of a lateral pivoting biassing arrangement of the embodiment of FIG. 1.

The side-to-side motion of the neck is controlled by means of a pushrod 64. As best seen in FIG. 7, one end of the pushrod 64 is pivotally mounted to the centre of a plate 66 fixedly connected to the lateral pivoting member 30. The pushrod 64 is biassed forwardly by means of a compression spring 67 which abuts a collar 70 fixedly mounted to the pushrod 64 and a further lateral bar 68 via a washer 69. The pushrod passes through a conical aperture 71 in the bar 68 to allow pivoting. The arrangement also includes a solenoid-actuated locking member 72 (FIG. 6) which is provided with a bolt 73 adapted to be receivable in an aperture 74 in the plate 66. When in position in the aperture, the bolt 73 prevents the spring 68 from displacing the neck portion of the apparatus from side-to-side to any significant degree. However, when the bolt 73 is withdrawn by actuation of the solenoid against the force of springs 75 which contact a plate to which the member is connected, then a slight displacement of the neck portion from the central position will cause the spring-actuated pushrod 64 to increase the displacement of the neck in that direction, thereby encouraging the rider to straighten the neck portion, as is commonly necessary during a horse race. The displacement of the neck is also caused to increase by means of the spring-loaded cable 50. This arrangement works for whichever way the neck is slightly displaced initially, since the pushrod 64 is pivotally mounted at the central portion of the lateral pivoting member 30 and the conical aperture 71 permits the pushrod 64 to swing slightly. The movement of the spring-actuated pushrod 64 is damped by means of a rotary vane dashpot 77 bolted to frame member 68 and connected to the plate 66 by means of two pivotally connected rods 79*a*, 79b. This arrangement restricts very rapid neck movements to either side, to produce smoother movements, similar to the movements of a real horse. The bolt 73 may be withdrawn automatically after a preset time delay and extended once again after a further preset time delay, so that a "rider" need not always have to straighten the neck.

An electric motor 78 is mounted on the upper surface of the base portion 10. The electric motor is provided with a gear box 80 having an output shaft 82 which is connected to a crank 84 whose opposite end is pivotally mounted at connecting pin 86 to a lower horizontal reinforcing member 46 of the body portion 12. It will also be noted that support members 88 are mounted on the upper surface of the base portion 10 in front of the electric motor, and that the front portion of the body portion is suspended from a support pivot 90 by means of a connecting bar 92 whose lower end is pivotally mounted to the lower frame portion 46. Two such arrangements are provided, one on each side of the device.

It will also be noted that each side of the rear portion of the body portion is provided with sensing means 96 just below the surface of the body portion 12, and having a central sensor 96*a* and upper and lower sensors 96*b*. These sensors are pressure sensors, sensitive to an impact. They are designed to be hit by the whip of a rider, the area corresponding to the main sensor 96*a* relating to the correct whipping area, and the areas relating to the sensor 96*b* corresponding to whipping areas which are slightly away from the correct whipping area 96*a*.

The apparatus is under the control of an electronic control means 98 mounted on the front of the body portion, and provided with adjustable control means 100.

In use, a saddle is secured to the body portion of the apparatus and reins are secured to the head portion 22. The rider then mounts the body portion and switches on the apparatus using the adjustable control 100. This causes the actuation of the motor 78, which causes the output shaft 82 to rotate, thereby producing a generally orbital motion of the body portion at its rear end. However, in view of the connecting rod 92 pivotally mounted to the base and the body portion in front of the motor, the front portion of the body portion 12 tends to swing between the two positions illustrated in chain dot in FIG. 2. The overall movement induced by the motor is very similar to that of a real horse. In particular, it will be noted that the loci of the two points A and B in FIG. 1 are as illustrated, and are very similar to the corresponding loci on a real horse.

The rider may thus simulate the riding of a horse, and in doing so can displace the neck and head of the apparatus downwardly, as would occur in normal riding. The spring-loaded arrangement of the pivotal mounting of the neck ensures that the rider feels a realistic resistance to the downward force, and thus the apparatus gives an accurate reproduction of a riding action.

After a preset time, adjustable by means of the electronic control 98, the solenoid 72 may be actuated to withdraw the bolt 73 from the aperture 74 and thereby allow the spring-actuated pushrod 64 to displace the neck and head to one side, if the neck and head are slightly displaced in that direction. In this way, the rider is encouraged to correct the sideways movement of the neck against the force of the spring 68, thereby simulating more accurately the movement of a horse during riding.

Moreover, the rider may also use his whip as he would do in a race, and the sensors 96*a* and 96*b* are arranged to generate signals which produce different sounds by means of the electronic control 98 and/or to light one or more LEDs on the control apparatus 98, so that he can be aware of whether he is whipping in the correct area. If no sound is heard or no visual indication given, then he is whipping in the wrong area, if the sound or LED corresponding to the area 96*b* is actuated then he knows he is whipping almost in the right area, and if the sound or LED corresponding to 96*a* is actuated, the rider knows he is whipping in the correct area.

The above apparatus may, of course, be used without actuation of the motor 78 if, for example, it is merely desired to concentrate on exercising the rider's arms by displacing the head and neck portion downwardly. Also, the speed of the motor may, of course, be varied by means of the electronic control 98.

I claim:

1. A horse riding training aid comprising a body portion, a neck portion pivotally mounted to, and extending from, the body portion, and a head portion pivotally mounted about a generally horizontal axis, to the distal end of the neck portion, the training aid further comprising link means extending between the head portion and the body portion which cause the head portion to pivot in the opposite direction to the neck portion.

2. A horse riding training aid according to claim 1, wherein the link means comprises first and second connecting rods extending between the body portion and the head portion and pivotally mounted to each about generally horizontal axes.

3. A horse riding training aid according to claim 2, wherein the first and second rods are in the form of a parallel linkage.

4. A horse riding training aid comprising a base, a body portion mounted on the base, a neck portion pivotally mounted to, and extending from, the body portion, and powered means for moving the body portion with respect to the base;

wherein the body portion is also hingedly connected to the base; and a crank mechanism connected to the body portion towards the rear of the body portion, wherein the body portion is hingedly connected to the base further to the front of the body portion.

5. A horse riding training aid comprising: a body portion, and a neck portion being pivotally mounted to said body portion about first and second inclined pivotal axes, wherein said first inclined pivotal axis is inclined generally to the horizontal, and said second pivotal axis is inclined both to the vertical and to the horizontal.

6. A horse riding training aid according to claim 5, wherein said first inclined axis is inclined upwardly towards the rear of the body portion.

7. A horse riding training aid according to claim 5, comprising:

a pivotal member which is pivotally mounted about the first inclined axis; and another pivotal member which is pivotally mounted about the second pivotal axis. wherein said first inclined pivotal axis is inclined generally to the horizontal, and said second pivotal axis is inclined both to the vertical and to the horizontal.

8. A horse riding training aid comprising a base, a body hingedly connected to the base, a neck portion pivotally mounted to, and extending from, the body portion, a crank mechanism, and an electric motor for moving the body portion with respect to the base, the electric motor being connected to, and arranged to drive said crank mechanism, one end of which is pivotally connected to the body portion towards the rear of the body portion, and the body portion being hingedly connected to the base further to the front of the body portion.

* * * * *

UNITED STATES PATENT AND TRADEMARK OFFICE

CERTIFICATE OF CORRECTION

PATENT NO : 5,429,515

DATED : July 4, 1995

INVENTOR(S): William R. Greenwood

It is certified that error appears in the above-identified patent and that said Letters Patent is hereby corrected as shown below:

Column 7, lines 9-12, delete "wherein said first inclined pivotal axis is inclined generally to the horizontal, and said second pivotal axis is inclined both to the vertical and to the horizontal."

Signed and Sealed this

Seventeenth Day of June, 1997

Bruce Lehman

*Attest:*

BRUCE LEHMAN

*Attesting Officer*

*Commissioner of Patents and Trademarks*